US008550453B2

(12) United States Patent
Cost

(10) Patent No.: US 8,550,453 B2
(45) Date of Patent: Oct. 8, 2013

(54) CURRENCY CASSETTE PRESSURE PLATE ASSEMBLY

(75) Inventor: Evan J. Cost, Audubon, PA (US)

(73) Assignee: MEI, Inc., Malvern, PA (US)

( * ) Notice: Subject to any disclaimer, the term of this patent is extended or adjusted under 35 U.S.C. 154(b) by 0 days.

(21) Appl. No.: 13/430,301

(22) Filed: Mar. 26, 2012

(65) Prior Publication Data

US 2012/0242210 A1 Sep. 27, 2012

Related U.S. Application Data

(62) Division of application No. 10/405,017, filed on Apr. 1, 2003, now Pat. No. 8,146,914.

(51) Int. Cl.
*B65H 1/02* (2006.01)

(52) U.S. Cl.
USPC ..... 271/149; 271/214; 271/219

(58) Field of Classification Search
USPC ..... 271/117, 178, 180, 181, 213, 215, 217, 271/219, 214, 218, 147, 149; 109/22–24, 109/45–47, 52, 55, 73, 74, 59 R, 59 T; 232/15, 16, 1 D, 31, 32
See application file for complete search history.

(56) References Cited

U.S. PATENT DOCUMENTS

| | | | | |
|---|---|---|---|---|
| 5,784,973 | A * | 7/1998 | Mercer et al. | 109/59 R |
| 6,394,007 | B2 * | 5/2002 | Lewis et al. | 109/59 R |
| 6,405,864 | B1 * | 6/2002 | Streich et al. | 206/373 |

FOREIGN PATENT DOCUMENTS

CH 662153 A5 * 9/1987

* cited by examiner

*Primary Examiner* — Jeremy R Severson
(74) *Attorney, Agent, or Firm* — Mintz Levin Cohn Ferris Glovsky and Popeo, P.C.

(57) ABSTRACT

An assembly includes a currency cassette, a pressure plate, and a plurality of gears rotatably connected to at least two opposite edges of the pressure plate. In an implementation, a plurality of substantially parallel racks are configured to engage a plurality of the gears.

7 Claims, 15 Drawing Sheets

CURRENCY CASSETTE PRESSURE PLATE ASSEMBLY

CROSS REFERENCE TO RELATED APPLICATIONS

The application is a divisional application of U.S. patent application Ser. No. 10/405,017 filed Apr. 1, 2003, which is incorporated herein its entirety.

TECHNICAL FIELD

This invention relates to a pressure plate assembly for stably storing currency, and more particularly to a pressure plate assembly that includes gears coupled to a pressure plate that are guided by racks.

BACKGROUND

Bill storage compartments of typical currency cassettes in automatic transaction machines include a platform, such as a pressure plate, to support a stack of bills. The pressure plate, along with any previously stacked bills, may be moved to stack newly received bills. As the number of bills in the stack increases, any slight variation between the plane of the pressure plate and the plane of the stacked bills during movement due to stacking may cause the stack to buckle. If the stack buckles, the currency cassette may be unable to accept any more bills for storage and thus the automatic transaction machine may require servicing. It is therefore important to minimize the variation between the plane of the pressure plate with respect to the plane of the stacked bills while stacking newly received bills. It is also important to maximize the space in the bill storage compartment of a currency cassette that is available for storing currency.

Pressure plate assemblies typically use one or more springs to bias the pressure plate in a certain direction. In a conventional assembly, the pressure plate uses a pin on each longitudinal edge, which fits into a slot of the storage compartment, to guide the pressure plate along the slot while newly received bills are stacked. Other pressure plate assemblies use a cantilever plate that is connected to a sleeve bearing that moves along a post to guide the pressure plate in order to stack newly received bills. Alternatively, a scissor mechanism coupled beneath the pressure plate may be used to move the pressure plate while stacking newly received bills.

A device and method to store currency in a currency cassette in a stable and space-efficient manner is needed.

SUMMARY

The present apparatus and method advantageously keeps a stack of bills of varying lengths and widths in an orderly fashion and stably supports the stack in a currency cassette by maintaining parallelism between the face of a stacked bill and the pressure plate.

In one aspect, the present invention discloses an apparatus that includes a currency cassette, a pressure plate, one or more gears rotatably connected to at least two substantially opposite edges of the pressure plate, and one or more substantially parallel racks configured to engage one or more of the gears.

In one embodiment of the apparatus, one or more of the gears may be connected to one or more shafts at a first edge of the pressure plate, one or more of the shafts may extend to a second edge of the pressure plate. One or more of the gears may be coupled to one or more of the shafts at the second edge of the pressure plate.

In another embodiment, one or more of the gears may be rotatably coupled to a drive mechanism having one or more drive gears coupled to a face of the pressure plate.

In yet another embodiment, the gears may be connected to opposite edges of the pressure plate using integral shafts. The apparatus may include a spring coupled to a face of the pressure plate and to a wall of the currency cassette to bias the pressure plate away from the wall. The pressure plate may be maintained substantially parallel to a face of a stacked bill. At least one of the substantially parallel racks may be integrally coupled to a side wall of the currency cassette and the racks may be made of plastic. The pressure plate may be maintained at an orientation that is substantially perpendicular to the racks.

The cassette may include a door that interlocks with the cassette walls when the door is closed. In one implementation, for example, the door includes projections, which, when the door is in a closed position, interlock with corresponding openings in sidewalls of the cassette. The interlocking projections can help maintain the integrity of the cassette in the event it is dropped or subject to some other force.

In a second aspect of the invention, a method for storing currency is disclosed that include transporting a bill such that it is adjacent an opening in a currency cassette, driving the bill through the opening and into a pre-storage compartment, stacking the bill onto a pressure plate in a direction substantially perpendicular to the face of the stacked bill and away from the opening. The method includes synchronously engaging a plurality of the gears rotatably connected to at least two substantially opposite edges of the pressure plate and mated to a plurality of substantially parallel racks, such that the pressure plate maintains an orientation that is substantially parallel to the face of the stacked bill at all times.

In one embodiment, the method may include driving the bill through the opening in a direction substantially perpendicular to the face of the stacked bill. The pressure plate may be biased in a direction towards the opening to stably maintain the stack.

The foregoing techniques may provide one or more of the following advantages. The techniques may minimize variation between the plane of the pressure plate with respect to the plane of the stacked bills while stacking newly received bills, in addition, the techniques may maximize space in a bill storage compartment of a currency cassette that is available for storing currency. Consequently, the techniques may provide solution for storing currency in a currency cassette in a stable and space-efficient manner.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
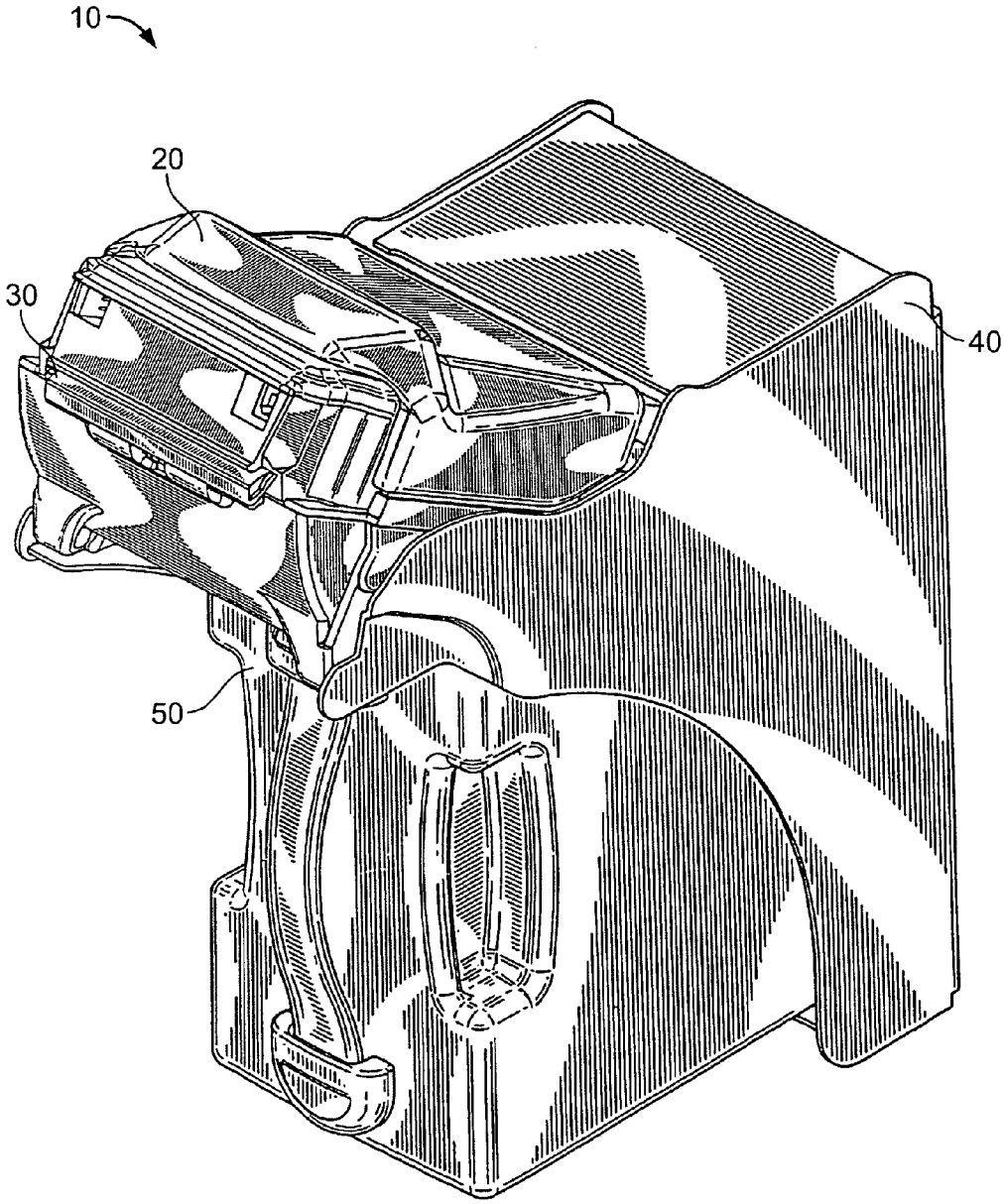
FIG. 1 is a perspective view of an assembly including a bill validator, frame and currency cassette, according to an embodiment of the invention.

FIG. 1 illustrates an implementation of a currency acceptor assembly 10, which may be used in an automatic transaction machine, such as a gaming machine or a vending machine. The assembly 10 includes a bill validator 20 coupled to a frame 40. A removable currency cassette 50 may be coupled to the bill validator 20 and frame 40. The currency cassette may include a stacker/pusher means 370 (shown in FIG. 6A). It should be noted that the term "bill" or "bills" include all forms of payment including, but not limited to, paper currency, banknotes, coupons, tokens, smart cards, debit cards, credit cards and security documents and the like.

The bill validator 20 determines whether an inserted bill is acceptable. Bills may be inserted one at a time into the bill validator using a bill entrance 30. Sensors are then used to ascertain the validity and denomination of the bill. Details of bill validation are beyond the scope of this application and will not be described in detail. If a bill is found to be unacceptable, it is ejected through the bill entrance 30. If a bill is determined to be acceptable, the bill is transported along a bill transport path 352 (shown in FIG. 6B) to a pre-storage compartment 355 (shown in FIG. 6B). The pre-storage compartment frames the bill and holds it in place. Once the accepted bill is fully transported into the pre-storage compartment, a stacker means 370 (shown in FIG. 6A) is operated to drive the accepted bill from the pre-storage compartment into a bill storage compartment 354 (see FIG. 7A) of the currency cassette where it is stored. Because the present invention is configured to work with a stacker means, further details regarding stacker means operation will be described below.

Figure 2:
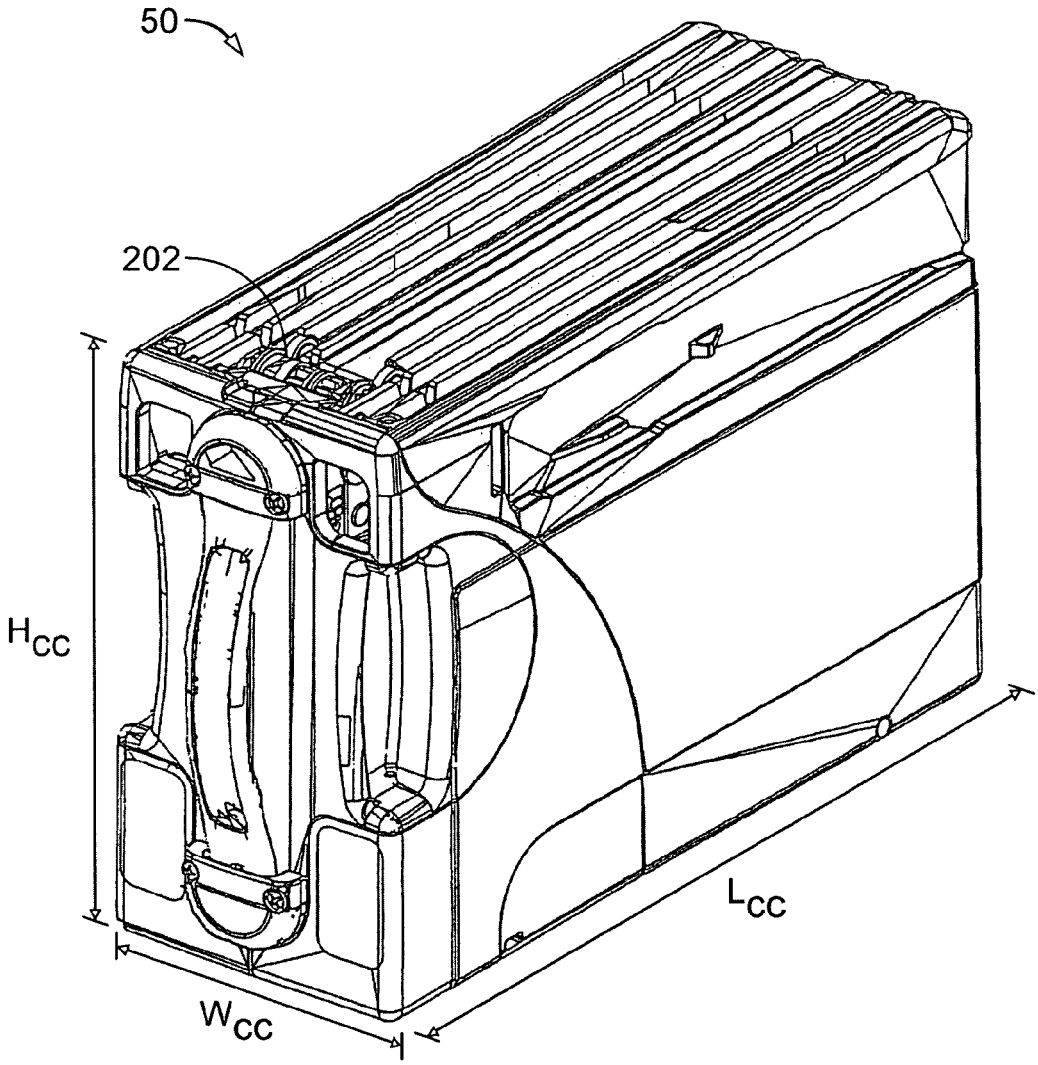
FIG. 2 is perspective view of a currency cassette removed from the frame, according to an embodiment of the invention.

FIG. 2 depicts the currency cassette 50 removed from the frame 40. The cassette has a height $H_{CC}$, length $L_{CC}$ and width $W_{CC}$, chosen to accommodate a predetermined number of bills of certain dimensions. The cassette includes a bill entrance 202 to the prestorage compartment. The currency cassette 50 includes a door 380 (shown in FIG. 4A) that can be opened so that the stored bills may be removed.

Figure 3A:
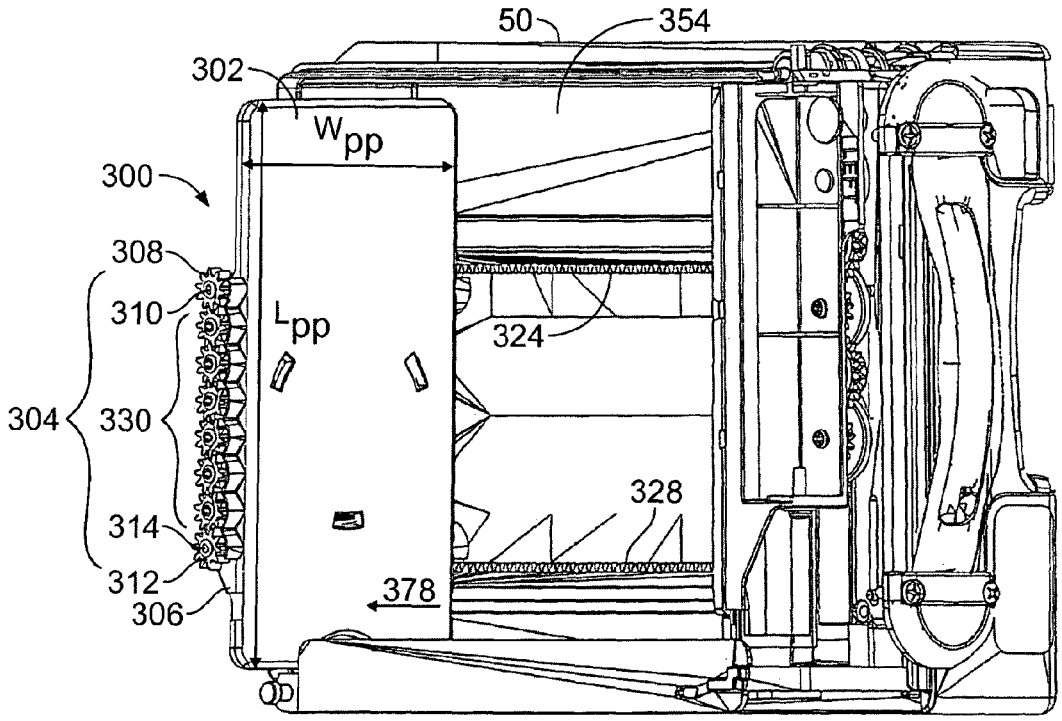
FIG. 3A is a cutaway perspective view of the left side of a pressure plate assembly in a currency cassette, according to an embodiment of the invention.
Figure 3B:
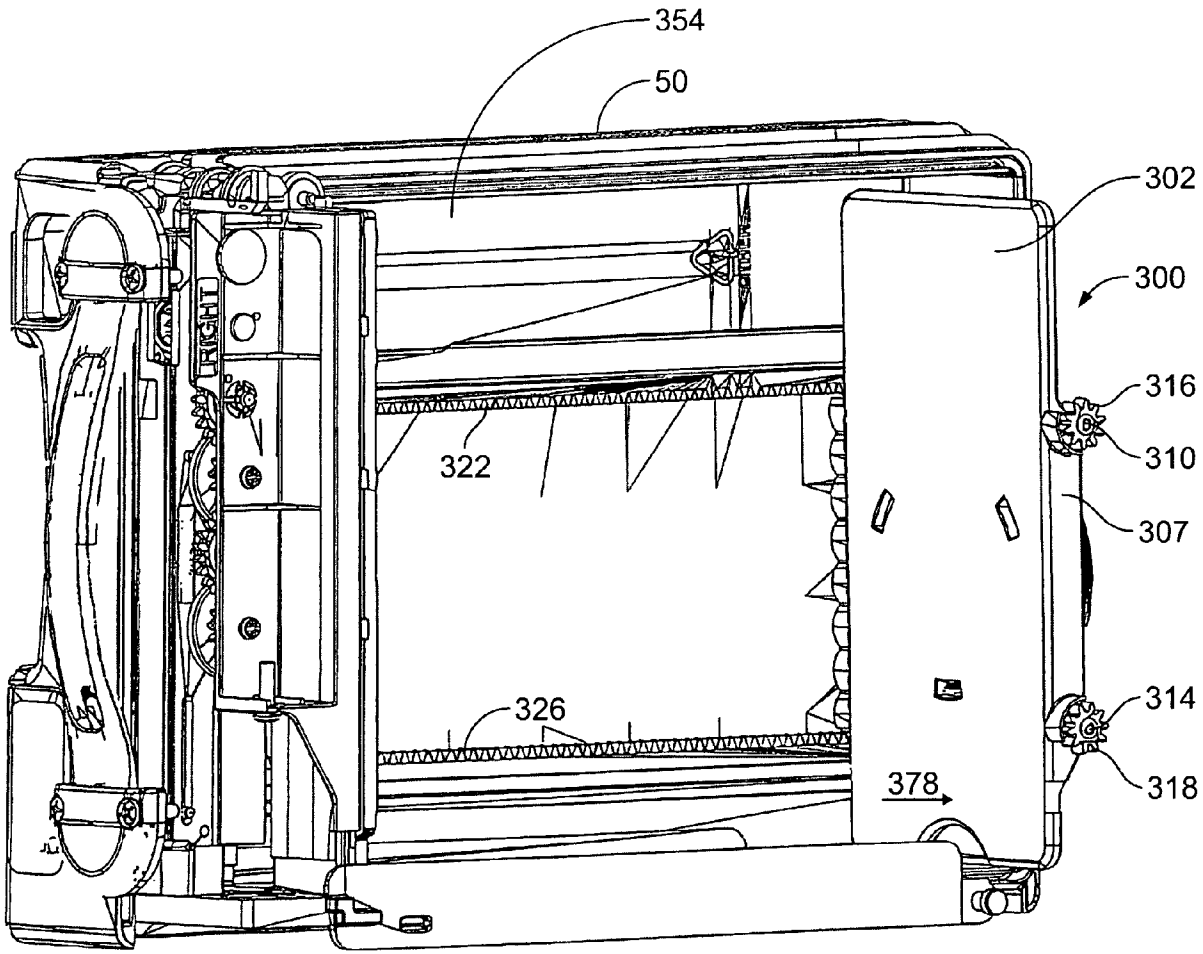
FIG. 3B is a cutaway perspective view of the right side of the pressure plate assembly in a currency cassette, according to an embodiment of the invention.

FIGS. 3A and 3B are left and right perspective cutaway views, respectively, of a pressure plate assembly 300 in a currency cassette. The automatic transaction machine may accept currency from various countries, which may be of varying sizes. Therefore, after continued use, a stack of bills supported by the pressure plate may consist of bills of many different lengths and widths. For example, the bottom of the stack may consist of a pile of two hundred bills of a small size underneath one hundred bills of a larger size, which are underneath two hundred bills of a smaller size as found in the multi-width and multi-length bills of the European note set. When such a stack increases in size, the stack may become unstable and tend to buckle due to the number of bills and the size differential of those bills in the stack. As a consequence of stack buckling, a currency cassette may jam and be unable to accept new bills to stack and require servicing. Therefore, it is important to maintain the orientation of the pressure plate to be substantially parallel to the face of a stacked bill as it moves to accommodate additional bills that are driven onto the stack using the bill stacker/pusher means.

It is also important to maintain the pressure plate substantially parallel to the face of the bills when service personnel remove bills from the currency cassette. If the stack were permitted to buckle, then one or more bills may fall out of the storage compartment when the cassette door is opened. As shown in FIGS. 3A and 3B, as bills are removed from the currency cassette, there is a likelihood that a point force 378 will be exerted on one edge of the pressure plate by service personnel as they are removing bills from the currency cassette. The pressure plate must be designed to resist this point force so that it will remain substantially parallel to the face of a stacked bill. In this way the stack of bills will not buckle as service personnel are removing the bills from the currency cassette.

Figure 4A:
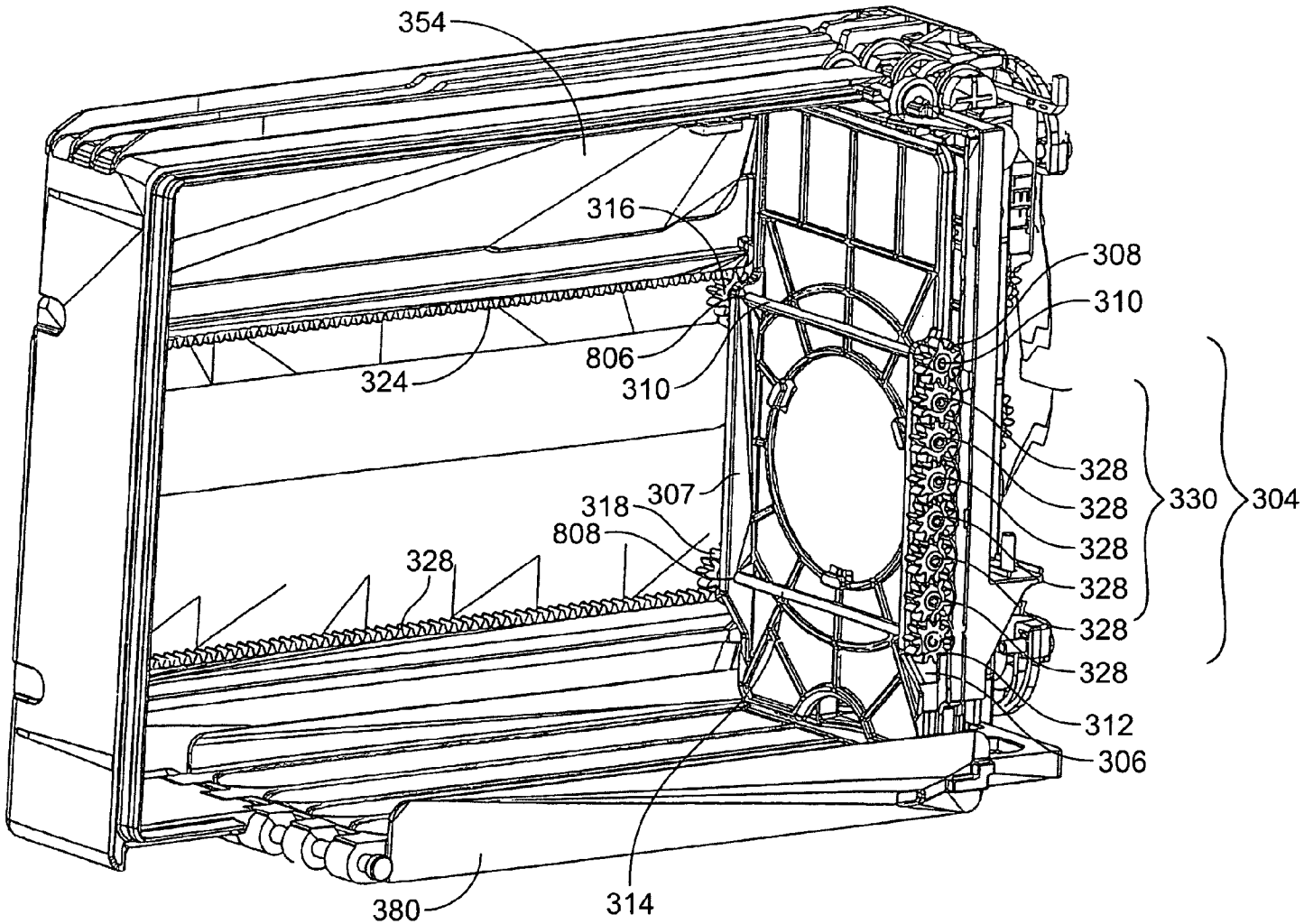
FIG. 4A is a bottom perspective view of the left side of the pressure plate assembly of FIGS. 3A-3B with a biasing spring removed for ease of reference.
Figure 4B:
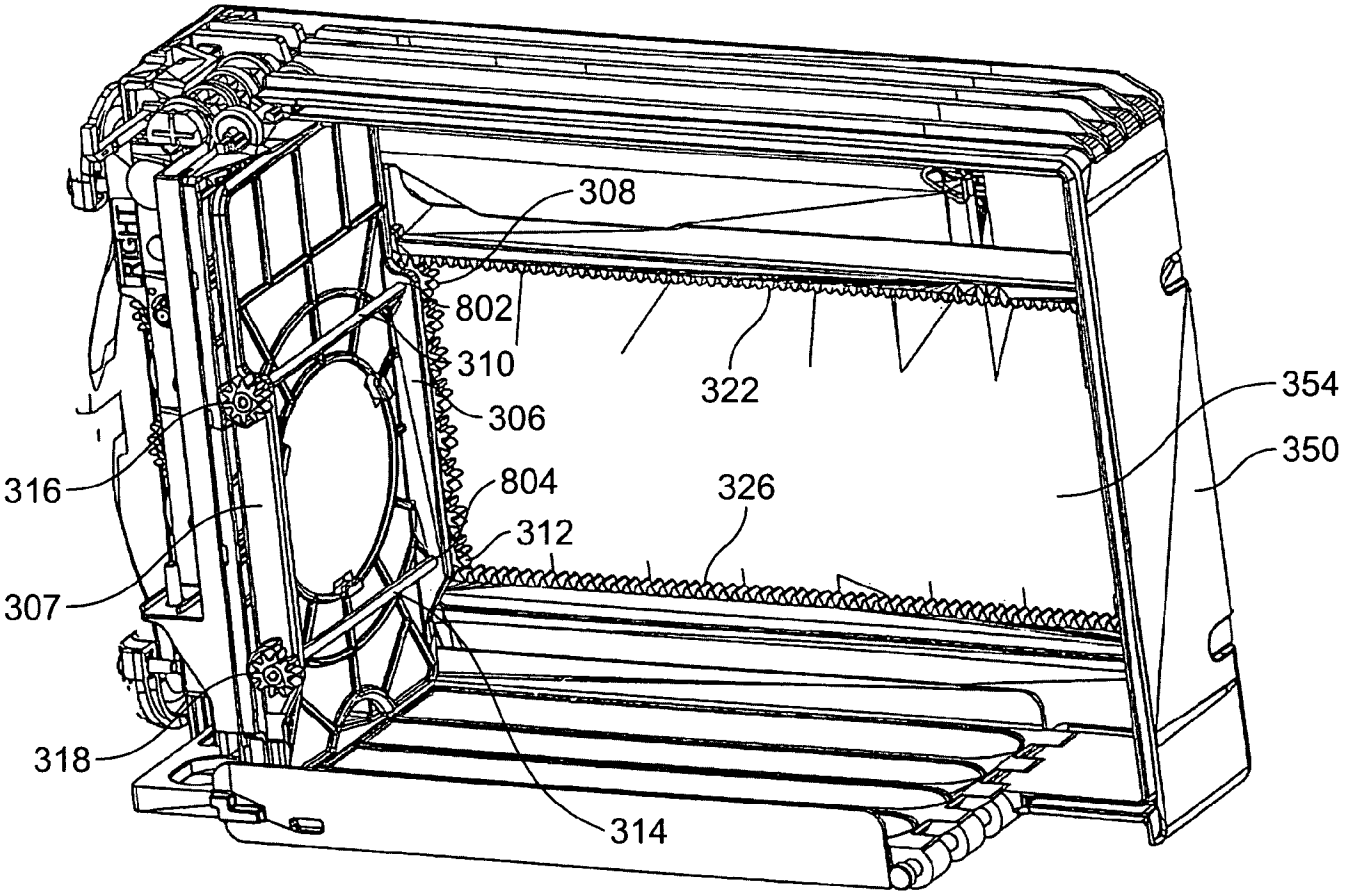
FIG. 4B is a bottom perspective view of the right side of the pressure plate assembly of FIGS. 3A-3B with a biasing spring removed for ease of reference.

The pressure plate assembly 300 stably stores bills in a currency cassette and includes a pressure plate 302 which may have a length $L_{PP}$, which is less than the height $H_{CC}$ of the currency cassette, and a width $W_{PP}$ which is less than the width $W_{CC}$ of the currency cassette. The pressure plate has a first longitudinal edge 306 (shown in FIG. 3A) and second longitudinal edge 307 (shown in FIG. 3B). Eight mated gears 304 are rotatably connected to the first longitudinal edge 306 of the pressure plate but any even number of gears may be used. A first end gear 308, which is one of the outermost gears of the even number of mated gears 304, is connected to one end of a first shaft 310. A second end gear 312, which is the other outermost gear of the even number of mated gears 304, is connected to one end of a second shaft 314. Referring to FIGS. 4A and 4B, which are bottom views of the assembly of FIGS. 3A-3B with a biasing spring removed for ease of reference, the first and second shafts 310, 314 are fed through respective holes 802, 804 in the first longitudinal edge 306 of the pressure plate. These shafts 310, 314 extend to the second longitudinal edge 307 of the pressure plate and are fed through respective holes 806, 808 in the second longitudinal edge 307 of the pressure plate. A first matching gear 316 is coupled to the first shaft 310 and is rotatably connected to the second longitudinal edge 307 of the pressure plate. A second matching gear 318 is coupled to the second shaft 314 and is rotatably connected to the second longitudinal edge 307 of the pressure plate. The rotation of the end gear and the matching gear on each shaft 310, 314 are synchronized. Therefore, the two gears connected to the shaft act as one.

Referring to FIGS. 3A and 4A, idler gears 330 are positioned in between the first end gear 308 and the second end gear 312 to link the first and second end gears. The idler gears 330 are rotatably connected to the first longitudinal edge 306 of the pressure plate using integral shafts 328. Alternatively, the first and second end gears may be linked together by coupling a first coupling gear to the first shaft and a second coupling gear to the second shaft. An even number of intermediate shafts between the first and second shafts may extend from the first longitudinal edge of the pressure plate to the second longitudinal edge of the pressure plate. An idler gear is coupled to each intermediate shaft. The idler gears are used to mate with the first coupling gear and the second coupling gear. Thereby, the first end gear is linked to the second end gear. Alternatively, the first end gear and the second end gear may be linked together using gears, shafts and/or belts. In an implementation, six idler gears may be used. Using a greater even number of gears in between the end gears will make the pressure plate assembly more resistant to the point force 378 applied by the service personnel while removing bills from the currency cassette because the gears and racks will be located closer to the non-longitudinal edges of the pressure plate. However, the backlash associated with the use of a large number of gears must also be considered. Using a lesser even number of gears in between the end gears, for example, two idler gears, may make the gears bind in response to the point force. In an embodiment, the mated gears 304 are located closer to the non-longitudinal edge of the pressure plate where the point force will be applied. Using this configuration the pressure plate assembly will be more resistant to the point force. The pressure plate assembly 300 also includes a spring 320 coupled to the bottom of the pressure plate 302 and to a wall 350 (shown in FIGS. 6A-6B) of the currency cassette to bias the pressure plate away from the wall.

Referring back to FIGS. 3 A and 4A, the pressure plate assembly 300 includes a plurality of substantially parallel racks 322, 324, 326, 328 to engage the first end gear 308, the first matching gear 316, the second end gear 312 and the second matching gear 318, respectively. Also shown is a bill storage compartment 354. The racks 322, 324, 326, 328 may be integrally molded to the side walls of the currency cassette, in an embodiment, the racks may be made of plastic or molded polycarbonate. Plastic or molded polycarbonate racks are less likely to deform than metal racks if the currency cassette is dropped.

Figure 5:
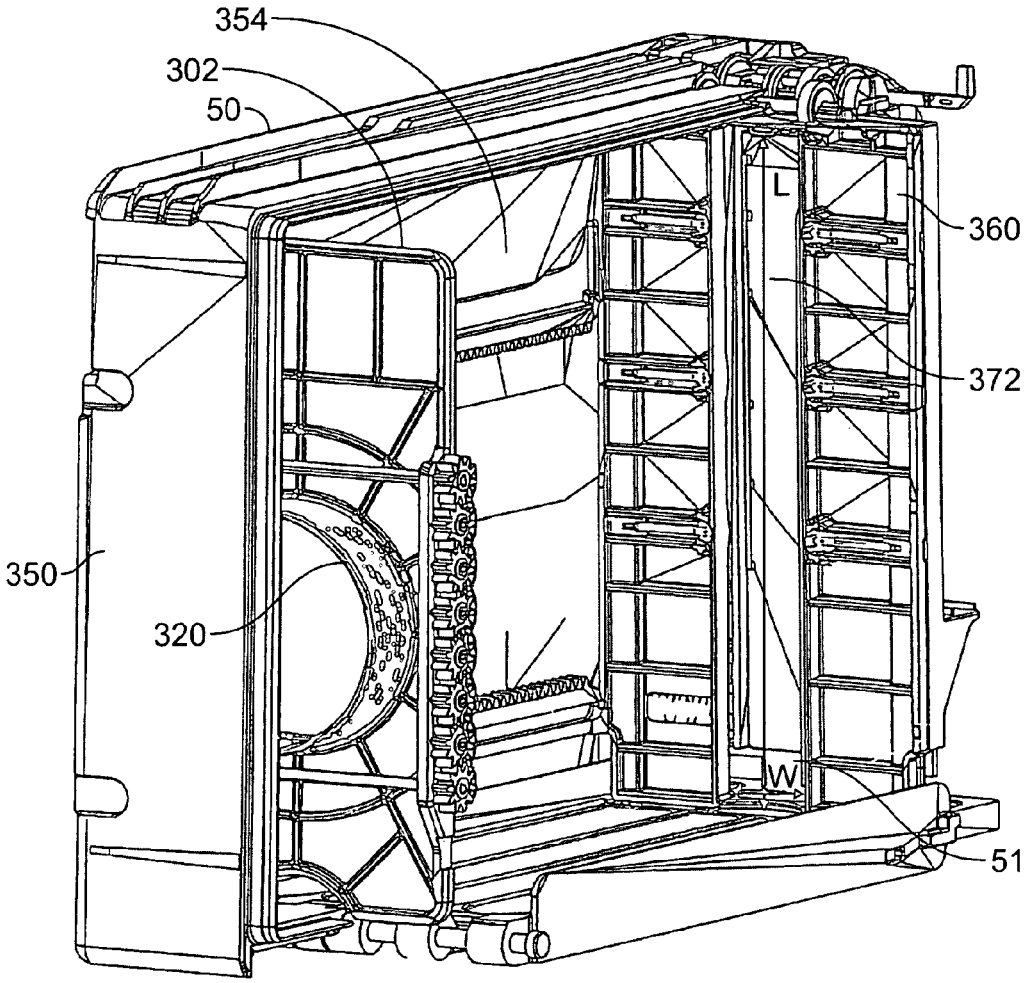
FIG. 5 is a bottom perspective view of the aperture plate in the currency cassette of FIGS. 3A-3B.
Figure 6A:
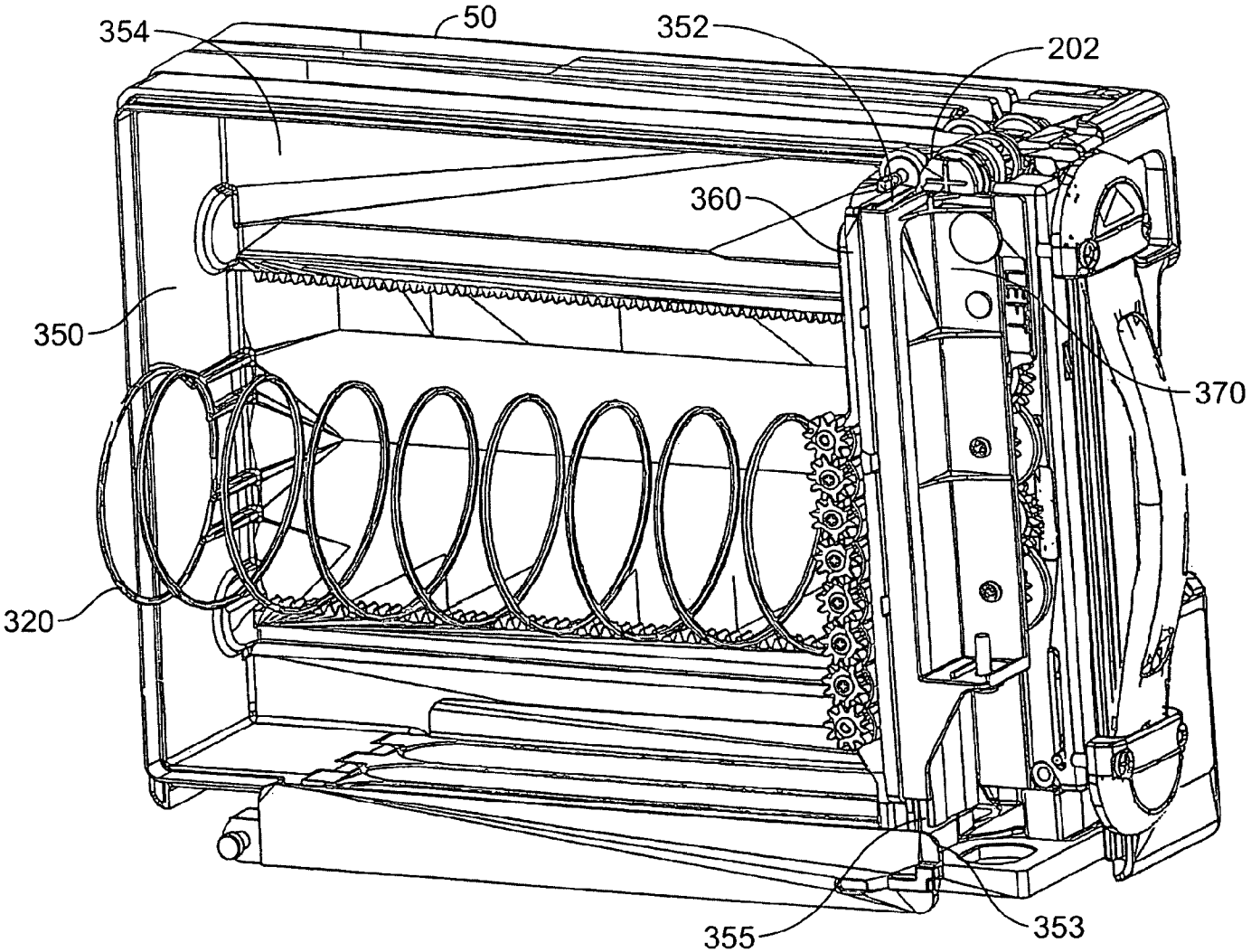
FIG. 6A is a cutaway perspective view of the left side of the pressure plate assembly in the empty currency cassette of FIGS. 3A-3B.
Figure 6B:
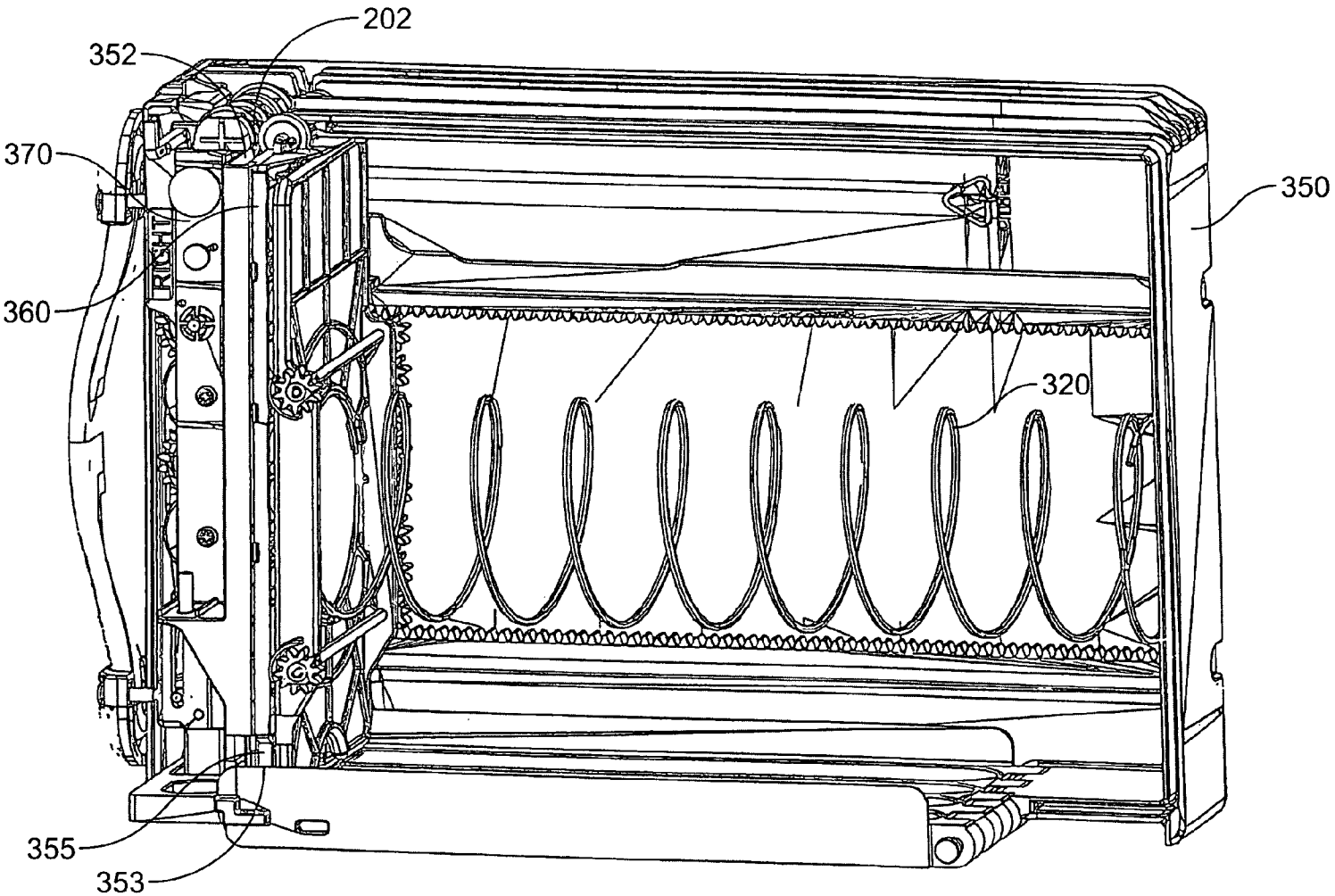
FIG. 6B is a cutaway perspective view of the right side of a pressure plate assembly in the empty currency cassette of FIG. 6A.
Figure 6C:
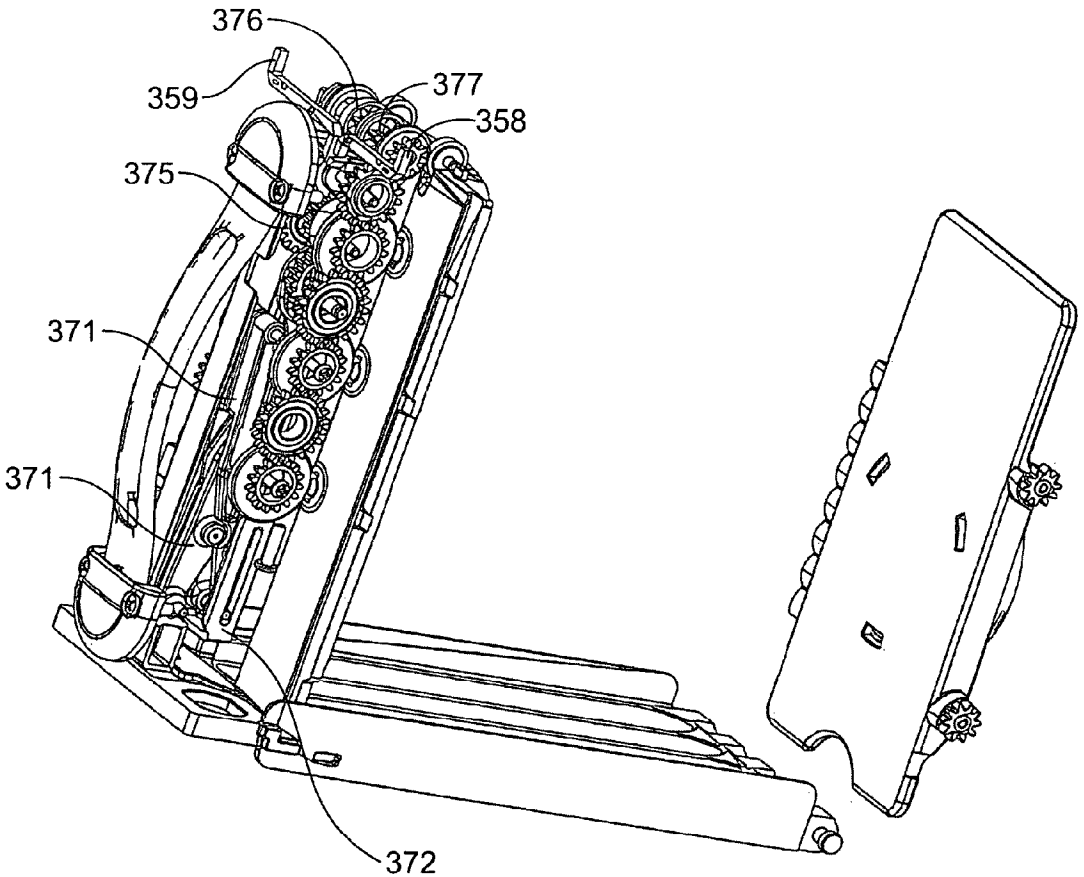
FIG. 6C is a simplified exploded view of the stacker means of the currency cassette.

FIG. 5 is a bottom cutaway perspective view of the aperture plate. A spring 320 may be coupled to the rear wall 350 of the currency cassette and is shown in a contracted state, as if the bill storage compartment 354 were full of bills. The spring 320 functions to bias the pressure plate 302 toward the aperture plate 360. The aperture plate defines the sides of a rectangular opening 51 that has a width "W", which is less than the width of a bill, and a length "L" which may be longer than the length of a bill. FIGS. 6A-6B are left and right cutaway perspective views of the empty currency cassette, and include a stacker/pusher means 370. The currency cassette includes a bill transport pathway 352.

Referring to FIGS. 5 and 6A-6C, the stacker/pusher means 370 includes a pusher plate 372 having a width that is narrower than the width W of the opening 51 in the aperture plate of the currency cassette. The stacker/pusher means 370 also includes actuation gears 375, 376, 377 coupled to a scissors mechanism 371 which is coupled to the pusher plate 372. The stacker/pusher means is activated upon receiving an indication that a bill has properly reached the end 353 of the prestorage compartment. In an implementation, the currency cassette includes a prism with two ends 358, 359. When the bill validator and the currency cassette are connected to the frame, one end of the prism is directly in front of a LED which may be on a printed circuit board in the bill validator, and the other end of the prism is directly in front of a receiver which may be on a printed circuit board of the bill validator. This system, which includes the prism, the LED, and the receiver, is used as a sensor. In the absence of a bill, when light is emitted from a LED, it travels through the prism from one end to the other and is detected by the receiver to form a continuous light path. During operation, an accepted bill leaves the bill validator and is fed through the bill entrance 202 to the bill transport pathway 352 of the currency cassette.

During this time, the continuous light path will be interrupted by the leading edge of the bill.

The bill will continue to obstruct the continuous path of light until a majority of the bill has been transported along the bill transport pathway 352 into the pre-storage compartment. As mentioned above, when a majority of the bill reaches the bill transport pathway, the bill no longer interrupts the continuous light path.

Once the continuous light path has been re-established, the sensor system will send a signal to the stacker/pusher means 370 to drive the bill towards the bill storage compartment 354 of the currency cassette. The actuation gears, which are connected to the scissors mechanism 371, cause the scissors mechanism to expand. Because the scissors mechanism is connected to the pusher plate 372, the pusher plate contacts and drives the bill through the opening 51 of the aperture plate and into the bill storage compartment 354. The edges of the bill deform or fold along its longest dimension as the pusher plate 372 drives it through the opening 51 and into the bill storage compartment. As the bill is pushed more deeply into the bill storage compartment 354, the edges of the bill unfold on the other side of the edges of the opening 51 of the aperture plate.

The pusher plate 372 drives the bill through opening 51 to contact the stack of bills on the pressure plate 302. The pusher plate 372 stacks the bill onto the pressure plate 302 such that the face of the bill is substantially parallel to the surface of the pressure plate. The stacker/pusher means 370 causes the pressure plate 302 to move in a direction substantially perpendicular to the face of the stacked bill and away from the opening 51. The pressure plate 302 maintains an orientation substantially parallel to the face of the stacked bills throughout the storing process by rotating the gears coupled to the pressure plate in synchronization along the racks.

As the pusher plate 372 exerts a force on the pressure plate 302 in a direction towards the rear wall 350 of the currency cassette 50, the first end gear 308 and first matching gear 316 which are connected together by a first shaft 310 rotate as a first unit along their corresponding racks 322, 324. At the same time, the second end gear 312 and the second matching gear 318, which are connected by a second shaft 314, rotate as a second unit along their corresponding racks 326, 328. The idler gears 330 synchronize the rotation of the first and second units along the substantially parallel racks. Therefore, the pressure plate 302 maintains its orientation substantially parallel to the face of a bill.

Once the bill has been stacked on the pressure plate, the pusher plate 372 is retracted to its normal position in front of the bill transport pathway 352. Because the pusher plate 372 is no longer contacting the pressure plate 302 the spring 320 forces the pressure plate along with the stacked bills towards the inner surface of the aperture plate 360. As explained above, the opening 51 in the aperture plate is too small for a bill to fit through without folding. Therefore, the most recently stacked bill will not pass through the opening 51 in the aperture plate.

Figure 7A:
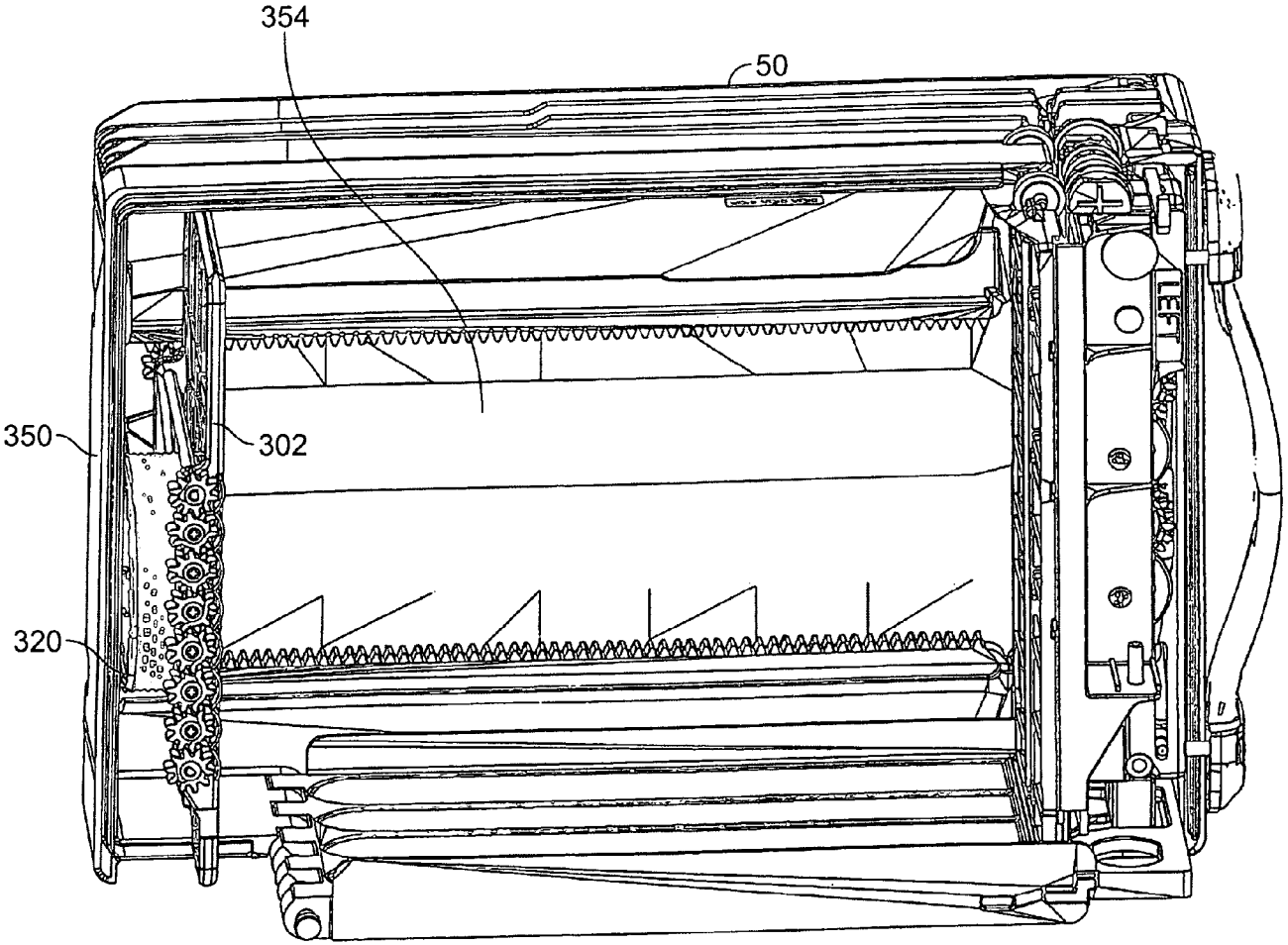
FIG. 7A cutaway side view of the left side of a pressure plate assembly in the currency cassette of FIGS. 3A-3B illustrating how the pressure plate moves to load and store bills in the currency cassette.
Figure 7B:
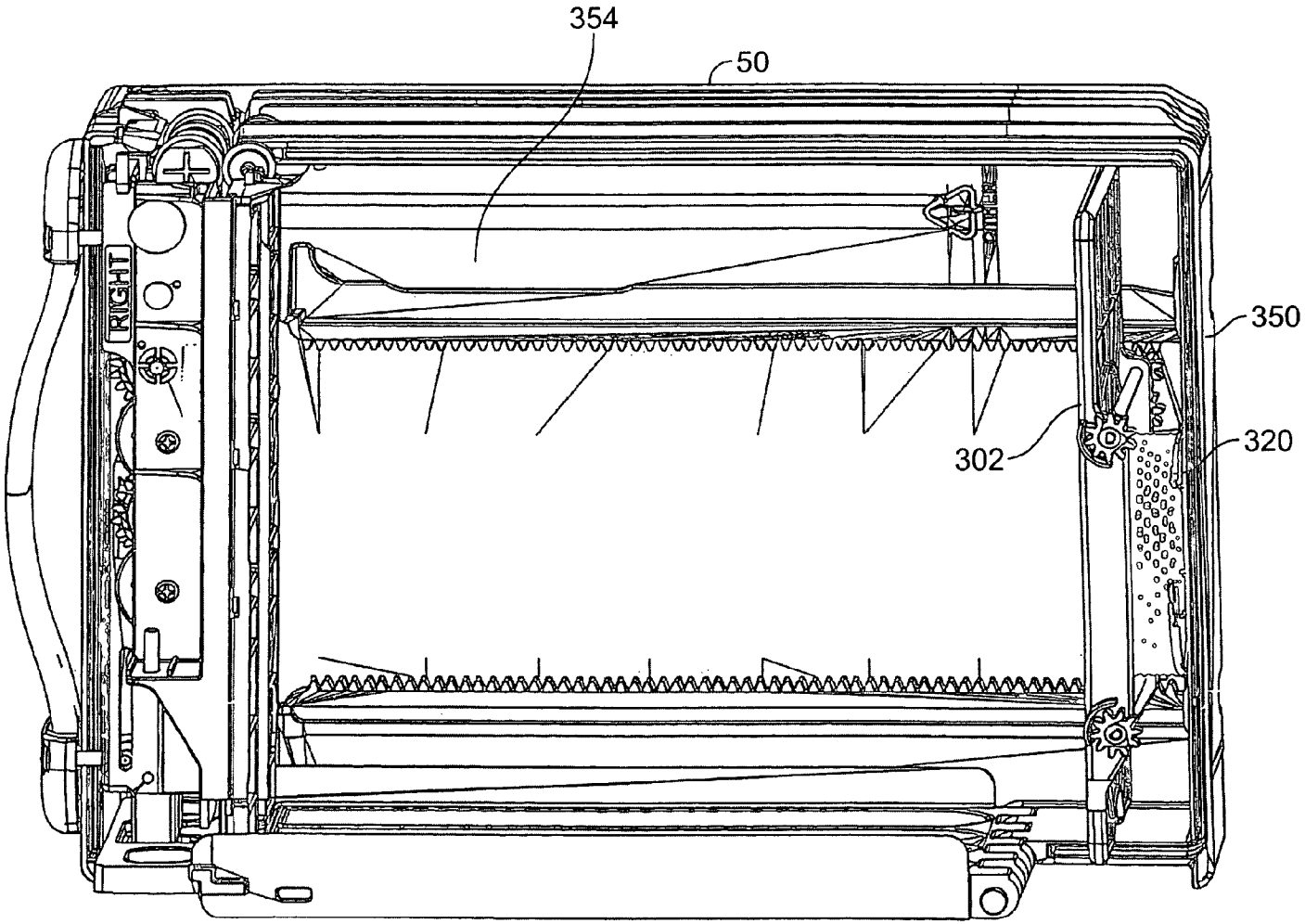
FIG. 7B is a cutaway side view of the right side of a pressure plate assembly in the currency cassette of FIGS. 3A-3B illustrating how the pressure plate moves to load and store bills in the currency cassette.

FIGS. 7A and 7B are a view of the left and right side of a currency cassette if the storage compartment were filled almost to capacity with bills. For ease of reference, the stacked bills are not shown. As shown, by mounting gears on the sides of the pressure plate 302 and using small gears, very little space beneath the pressure plate is required by the pressure plate assembly. Therefore, when storing bills, the pressure plate may be forced nearly against the rear wall 350 of the currency cassette such that very little space remains between the bottom of the pressure plate and the rear wall of the currency cassette. In an embodiment, a maximum of over 2000 bills may be stored inside the bill storage compartment 354 of the currency cassette 50.

Figure 8:
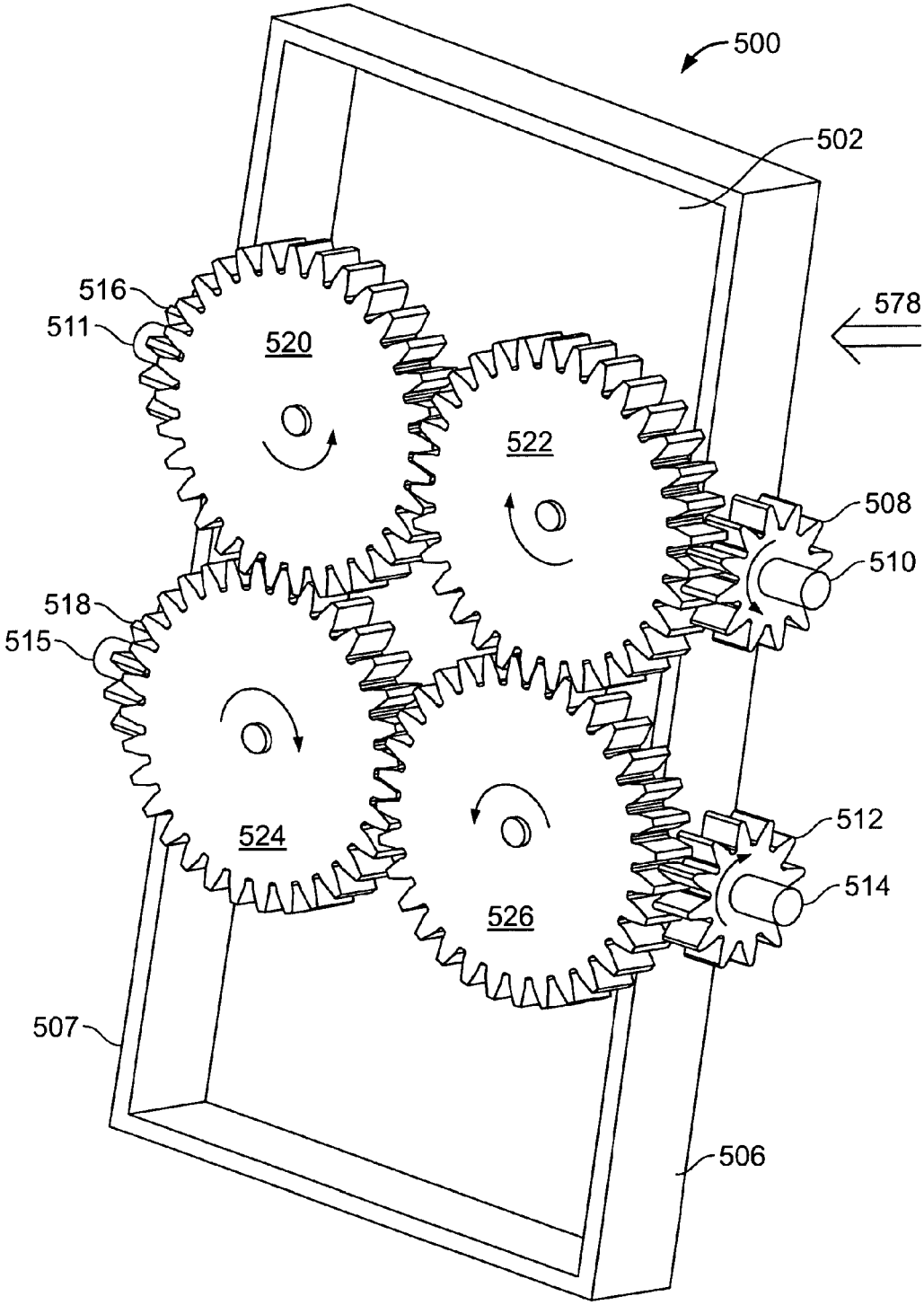
FIG. 8 is a perspective view of a pressure plate assembly according to an embodiment of the invention.

FIG. 8 is a perspective view of a pressure plate assembly 500 according to an alternative embodiment of the invention. The pressure plate assembly 500 includes a pressure plate 502 having a drive mechanism that includes drive gears 520, 522, 524, 526 instead of shafts 310, 314 as used in pressure plate 300 shown in FIG. 3. Referring to FIG. 8, the pressure plate 502 has a first longitudinal edge 506 and a second longitudinal edge 507. Mated gears 508, 512 are rotatably connected to the first longitudinal edge 506 through integral shafts 510, 514 respectively. Similarly, mated gears 516, 518 are rotatably connected to the second longitudinal edge 507 through integral shafts 511, 515 respectively. Mated gears 508, 512 are synchronized with mated gears 516, 518 through drive gears 520, 522, 524, 526. So a pressure force 578 applied to a face of the pressure plate 502, causes the gears to rotate in synchronization as shown by the curved arrows.

Figures 9A, 9B, 9C:
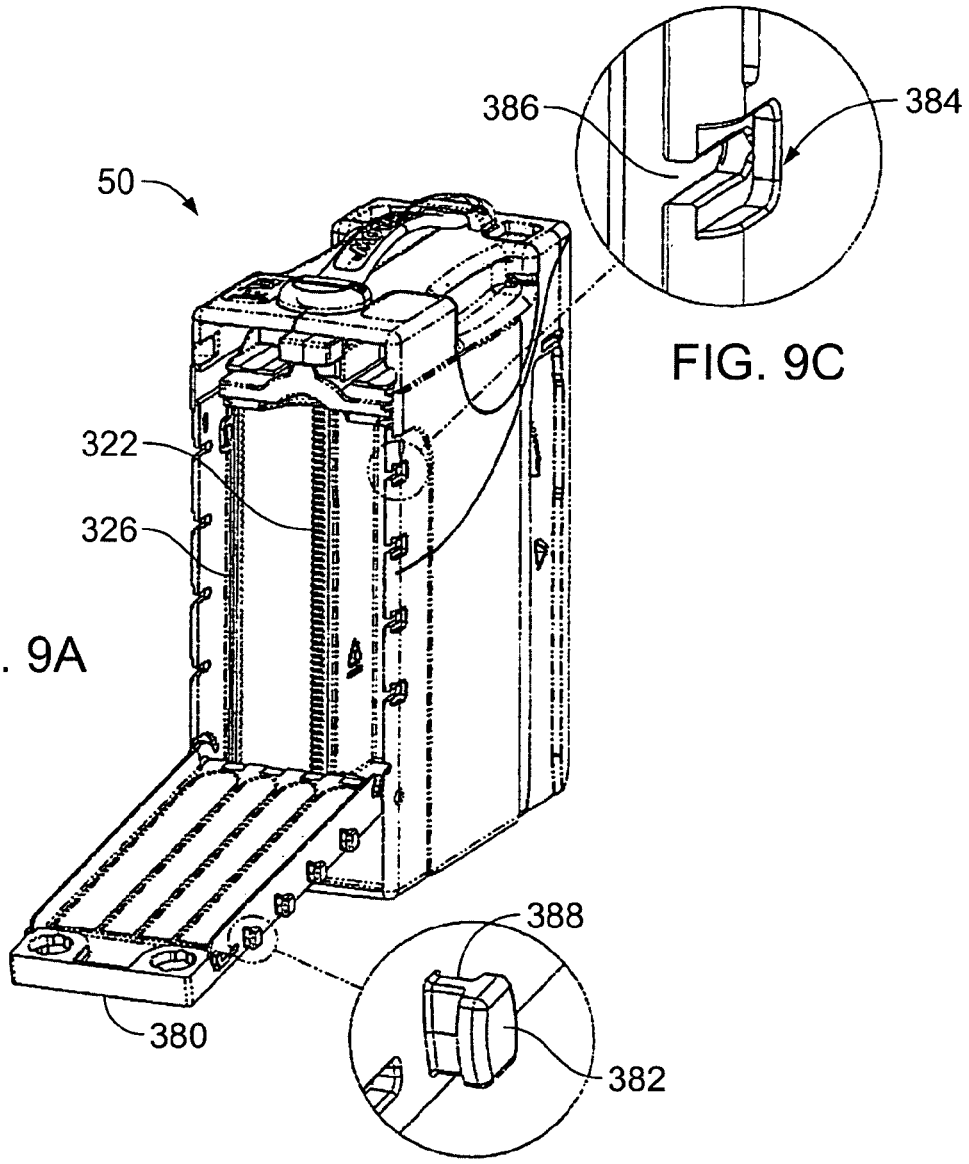
FIG. 9A illustrates the cassette with a door having features that interlock with the cassette sidewalls.
FIGS. 9B and 9C are exploded views of the interlocking mechanism according to one implementation.
Figure 10B:
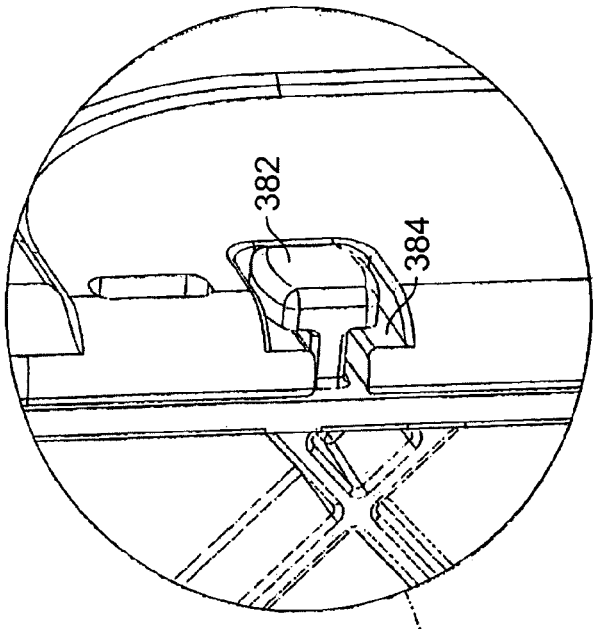
FIG. 10B is an exploded view of the interlocking mechanism with the door in the closed position.
Figure 10A:
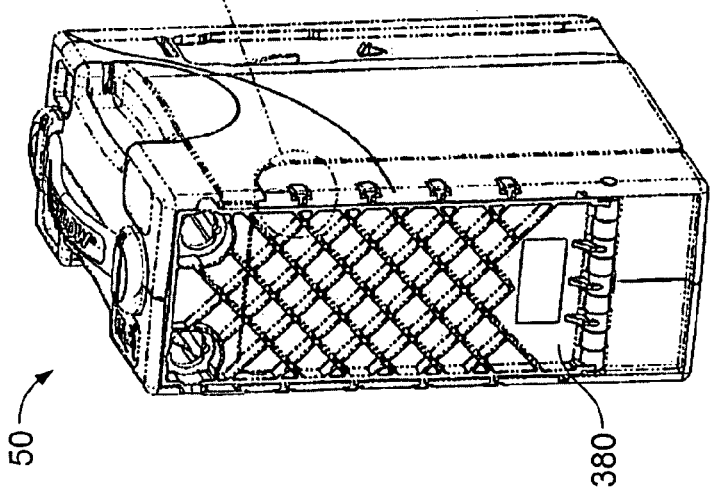
FIG. 10A illustrates the cassette door of FIG. 9A in the closed position.

As illustrated by FIGS. 9 and 10, the cassette door 380 may interlock with the cassette walls when the door is in the closed position. For example, in one implementation, the door 380 includes projections 382 which can be used to interlock the door with the body of the cassette 50 and help maintain the integrity of the cassette in the event it is dropped or subjected to some other shock. FIG. 9A illustrates the door 380 in an open position. One or more projections 382 such as lugs extend from each side of the door 380. When the door is in the closed position (see FIG. 10A), an outer portion of each projection 382 fits into a corresponding recess 384 in the sidewalls of the cassette. A thinner, inner portion 388 of each projection 382 fits into a corresponding cut-out region 386 in the sidewalls of the cassette. When the door is closed, the projections 382 interlock with the sidewalls of the cassette to help restrain the sidewalls and prevent the gears on the pressure plate from becoming unmeshed with the racks (e.g., racks 322, 326). The cassette typically may include one or more locks (not shown) located in the openings 390 in the door. The door may be locked in the closed position to prevent unauthorized access to the contents of the cassette.

Other designs may be used to interlock the cassette door to the walls when the door is in the closed position. For example, the door 380 may include extensions (not shown) that partially wrap around the sides of the cassette when the door is closed. The projections or extensions may provide an inward force on opposing sidewalls of the cassette when the door is in a closed position, thereby helping maintain the integrity of the cassette. In other implementations, projections on the cassette sidewalls may interlock with corresponding openings in the door or the interlocking may be achieved with substantially continuous walls.

One skilled in the art understands that various modifications may be made without departing from the spirit and scope of the described invention. For example, although in the embodiment described above, the bill transport pathway was formed in the currency cassette, in alternative embodiments, the bill transport pathway may be formed by the combination of the currency cassette and the stacker/pusher means. One half of the bill transport pathway may be formed by the currency cassette and the other half of the bill transport pathway is formed by the stacker/pusher means.

Although, an embodiment has been described in which a spring coupled to the pressure plate provides a bias pressure, other forms of bias pressure may be possible. For example, bias pressure can be provided by a torsion spring around a shaft. Pressure also may be generated by means other than a spring. For instance, resilient foam, a magnetic force, a gas strut, a motor drive, or other means may be used.

Also, although an embodiment in which the idler gears are rotatably connected to the first longitudinal edge of the pressure plate using integral shafts has been described, the idler gears may be located elsewhere. In an alternative embodiment, a first coupling gear may be included on the first shaft and second coupling gear may be included on the second shaft. An even number of intermediate shafts may extend from the first longitudinal edge to the second longitudinal edge. An idler gear may be coupled to each of the intermediate shafts. The idler gears on the inner shafts may mate with each other and the idler gears on the outermost intermediate shafts may mate with the first and second coupling gears. Accordingly, other embodiments are within the scope of the following claims.

What is claimed:

1. A method of preserving the integrity of a currency cassette comprising walls, a door, and substantially parallel racks on the walls to engage gears connected to a pressure plate, the method comprising:

closing the door of the cassette; and interlocking the cassette door with the walls of the cassette;

wherein the door comprises a plurality of projections each projection configured to fit within a corresponding recess, the corresponding recesses disposed along at least two parallel walls of the cassette, each projection comprising an outer portion and an inner portion that is thinner than the outer portion, both the outer portion and the inner portion configured to fit within corresponding cut-out regions in the corresponding recess when the door is closed and restrain the at least two parallel walls of the cassette that contain the corresponding recesses by providing an inward force on the at least two walls when the cassette is subjected to a force.

2. The method of claim 1 wherein the projection comprises a lug.

3. The method of claim 1 wherein the walls are substantially continuous.

4. The method of claim 1, wherein the gears connected to the pressure plate include:

first and second end gears disposed at a first edge of the pressure plate and rotably connected to the pressure plate to engage directly the parallel racks;

a plurality of idler gears disposed at the first edge of the pressure plate, rotatably connected to the pressure plate and positioned to link the first and second end gears; and wherein the pressure plate is maintained substantially parallel to a face of a stacked bill.

5. A currency cassette comprising:

a plurality of walls;

substantially parallel racks on at least two of the plurality of walls to engage gears connected to a pressure plate; and a door;

wherein the door comprises a plurality of projections each projection configured to fit within a corresponding recess, the corresponding recesses disposed along at least two parallel walls of the cassette, each projection comprising an outer portion and an inner portion that is thinner than the outer portion, both the outer portion and the inner portion configured to fit within corresponding cut-out regions in the corresponding recess when the door is closed and restrain the at least two parallel walls of the cassette that contain the corresponding recesses by providing an inward force on the at least two walls when the cassette is subjected to a force.

6. The currency cassette of claim 5 wherein the projection comprises a lug.

7. The currency cassette of claim 5, wherein the gears connected to the pressure plate include:

first and second end gears disposed at a first edge of the pressure plate and rotably connected to the pressure plate to engage directly the parallel racks;

a plurality of idler gears disposed at the first edge of the pressure plate, rotatably connected to the pressure plate and positioned to link the first and second end gears; and wherein the pressure plate is maintained substantially parallel to a face of a stacked bill.

* * * * *